US006547088B1

(12) United States Patent
Wang

(10) Patent No.: US 6,547,088 B1
(45) Date of Patent: Apr. 15, 2003

(54) COMBINATION TYPE SUPPORT RACK STRUCTURE

(76) Inventor: Lan-Fen Wang, 3 Floor, No. 14, Lane 13, Lin Si St., Taipei (TW)

( * ) Notice: Subject to any disclaimer, the term of this patent is extended or adjusted under 35 U.S.C. 154(b) by 0 days.

(21) Appl. No.: 10/004,730

(22) Filed: Dec. 4, 2001

(51) Int. Cl.[7] ..... A47B 57/30; A47B 57/06
(52) U.S. Cl. ..... 211/187
(58) Field of Search ..... 211/187

(56) References Cited

U.S. PATENT DOCUMENTS 3,848,844 A * 11/1974 Barrett ..... 248/245
4,299,368 A * 11/1981 Winkler ..... 248/246
5,941,399 A * 8/1999 Wang ..... 211/187
6,422,407 B2 * 7/2002 Arai ..... 211/189

* cited by examiner

*Primary Examiner*—Daniel P. Stodola
*Assistant Examiner*—Erica B Harris
(74) *Attorney, Agent, or Firm*—Alan Kamrath; Rider, Bennett, Egan & Arundel, LLP

(57) ABSTRACT

A combination type support rack structure includes multiple upright support posts, multiple separation boards mounted between the support posts, and multiple support and securing devices mounted on the support posts for supporting and securing the separation boards. Each face of each of the support posts is formed with at least one insertion groove. Each of the support and securing devices includes an insertion block received in the insertion groove, an ear seat protruded outward from one side of the insertion block, and a plate block pivotally mounted on the ear seat in an eccentric manner. Thus, the combination type support rack structure may be assembled easily and quickly, without having to use screws or tools, thereby saving time and manual work.

1 Claim, 5 Drawing Sheets

COMBINATION TYPE SUPPORT RACK STRUCTURE

BACKGROUND OF THE INVENTION

1. Field of the Invention

The present invention relates to a combination type support rack structure, and more particularly to combination type support rack structure that may be assembled easily and quickly, without having to use screws or tools, thereby saving time and manual work.

2. Description of the Related Art

A conventional support rack structure in accordance with the prior art comprises multiple longitudinal and transverse support racks combined with each other, thereby forming multiple spaces each provided with a bottom board for placing and supporting articles. In assembly, the longitudinal and transverse support racks are combined by a screwing method. However, the conventional support rack structure has a complicated construction, thereby causing difficulty and inconvenience in assembly. In addition, the positions of the longitudinal and transverse support racks are fixed and cannot be adjusted arbitrarily, thereby limiting the versatility of the conventional support rack structure.

SUMMARY OF THE INVENTION

The present invention has arisen to mitigate and/or obviate the disadvantage of the conventional support rack structure.

The primary objective of the present invention is to provide a combination type support rack structure that may be assembled easily and quickly, without having to use screws or tools, thereby saving time and manual work.

Another objective of the present invention is to provide a combination type support rack structure, wherein the support and securing device may be secured on any position of the support posts, thereby enhancing variation of space of the support rack structure of the present invention.

In accordance with the present invention, there is provided a combination type support rack structure, comprising: multiple upright support posts, at least one separation board mounted between the support posts, and multiple support and securing devices mounted on the support posts for supporting and securing the separation board, wherein:

- each face of each of the support posts is formed with at least one insertion groove;
- each of the support and securing devices includes an insertion block that may be received in the insertion groove, an ear seat protruded outward from one side of the insertion block, and a plate block pivotally mounted on the ear seat in an eccentric manner;
- the plate block of each of the support and securing devices is pivoted upward, whereby a gap is formed between the end face of a first end of the plate block and the surface of the support post, so that the insertion block of each of the support and securing devices may slide in the insertion groove of the support post freely to a predetermined position;
- the plate block of each of the support and securing devices may be pivoted downward, whereby the end face of the first end of the plate block is urged on the surface of the support post, so that the insertion block of each of the support and securing devices is secured in the insertion groove of the support post and the plate block of each of the support and securing devices is positioned on the surface of the support post.

Further benefits and advantages of the present invention will become apparent after a careful reading of the detailed description with appropriate reference to the accompanying drawings.

DETAILED DESCRIPTION OF THE INVENTION

Figure 1:
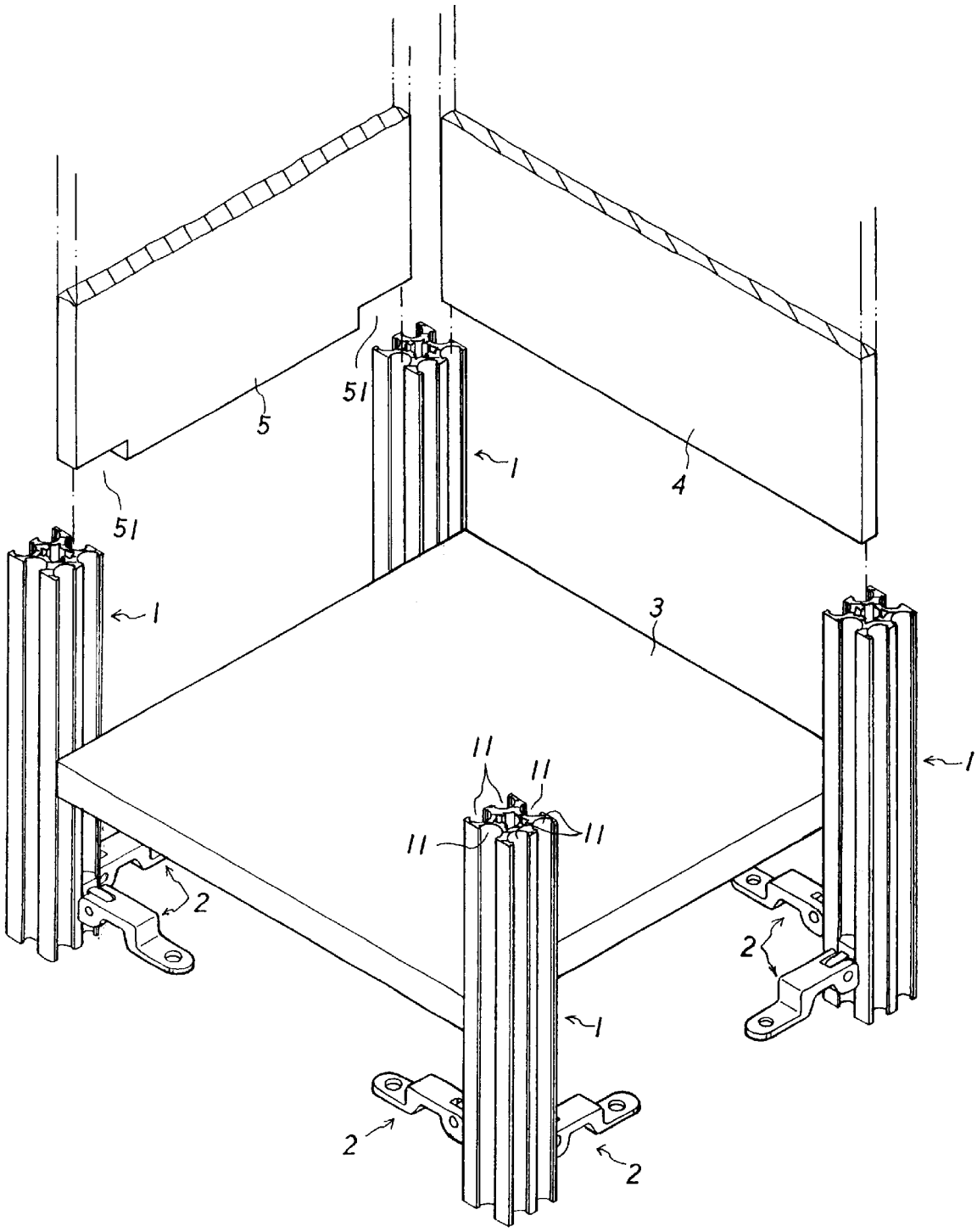
FIG. 1 is a perspective view of a combination type support rack structure in accordance with a preferred embodiment of the present invention.
Figure 2:
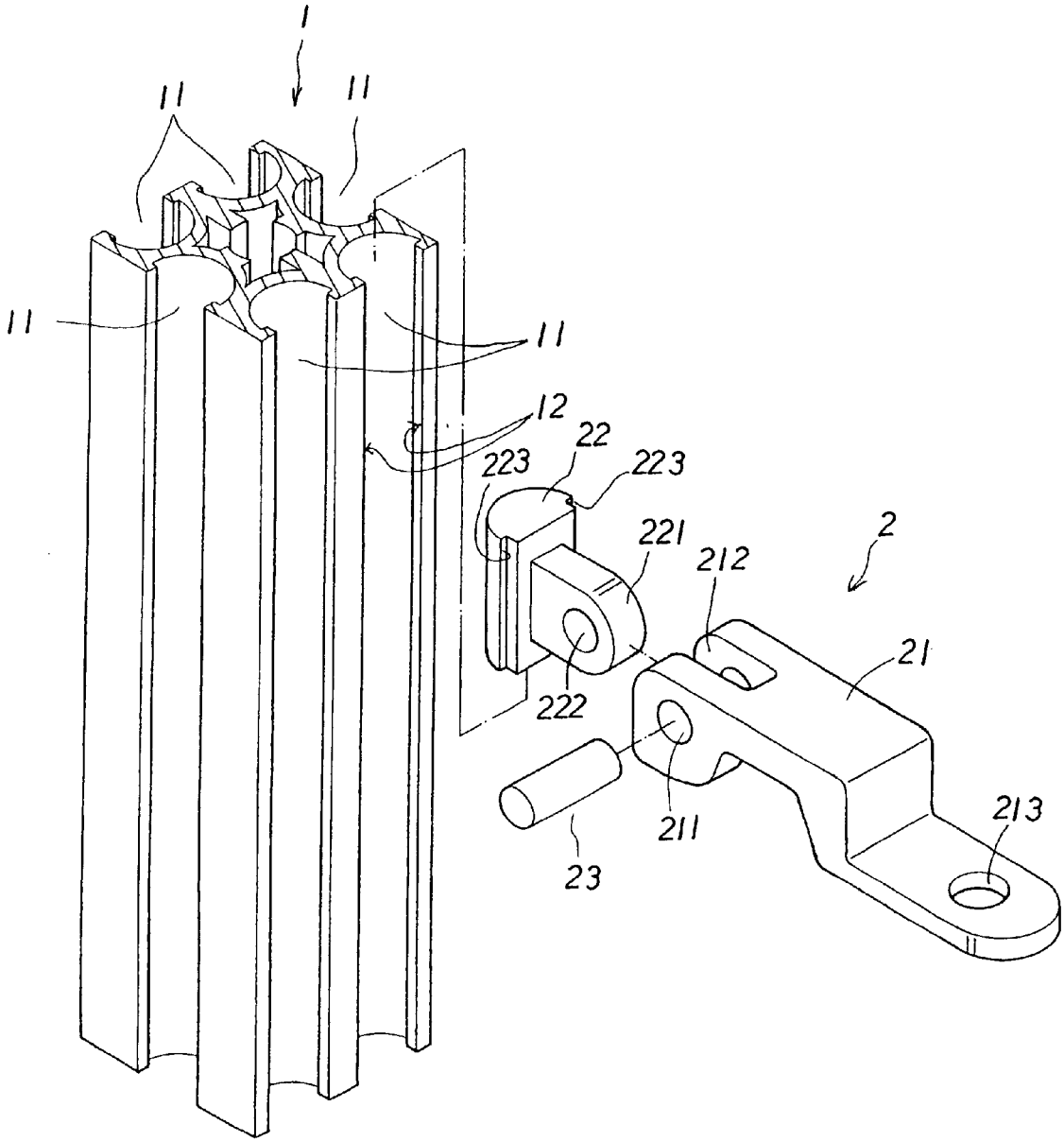
FIG. 2 is a partially exploded perspective view of the combination type support rack structure as shown in FIG. 1.
Figure 3:
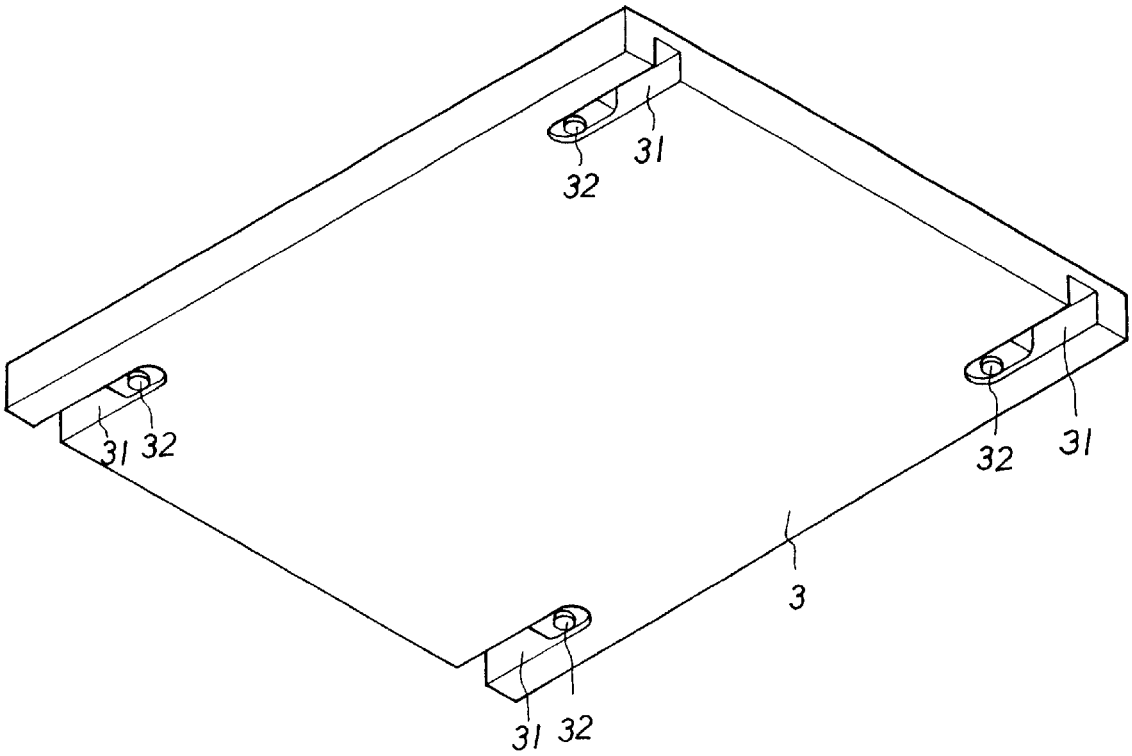
FIG. 3 is a perspective view of a separation board of the combination type support rack structure in accordance with the preferred embodiment of the present invention.

Referring to the drawings and initially to FIGS. 1–3, a combination type support rack structure in accordance with a preferred embodiment of the present invention comprises multiple upright support posts 1, at least one separation board 3 mounted between the support posts 1, and multiple support and securing devices 2 mounted on the support posts 1 for supporting and securing the separation board 3.

Each face of each of the support posts 1 is formed with at least one opened insertion groove 11 which has two side edges protruded with two flanges 12, so that the insertion groove 11 is substantially T-shaped.

Each of the support and securing devices 2 includes an insertion block 22 that may be received in the insertion groove 11. The insertion block 22 has two sides provided with two stop faces 223 rested on inner side faces of the two flanges 12 of the insertion groove 11. An ear seat 221 is protruded outward from one side of the insertion block 22, and is formed with a pivot hole 222. Each of the support and securing devices 2 includes a plate block 21 pivotally mounted on the insertion block 22. The plate block 21 has a first end formed with an opening portion 212 for receiving the ear seat 221 and formed with a pivot hole 211 whereby a pivot pin 23 may extend through the pivot hole 211 of the first end of the plate block 21 and the pivot hole 222 of the ear seat 221, so that the first end of the plate block 21 is pivoted on the ear seat 221 in an eccentric manner. The plate block 21 has a stepped second end formed with a positioning hole 213.

The separation board 3 has a bottom face formed with multiple stepped concave portions 31 each provided with a lug 32.

Figure 4:
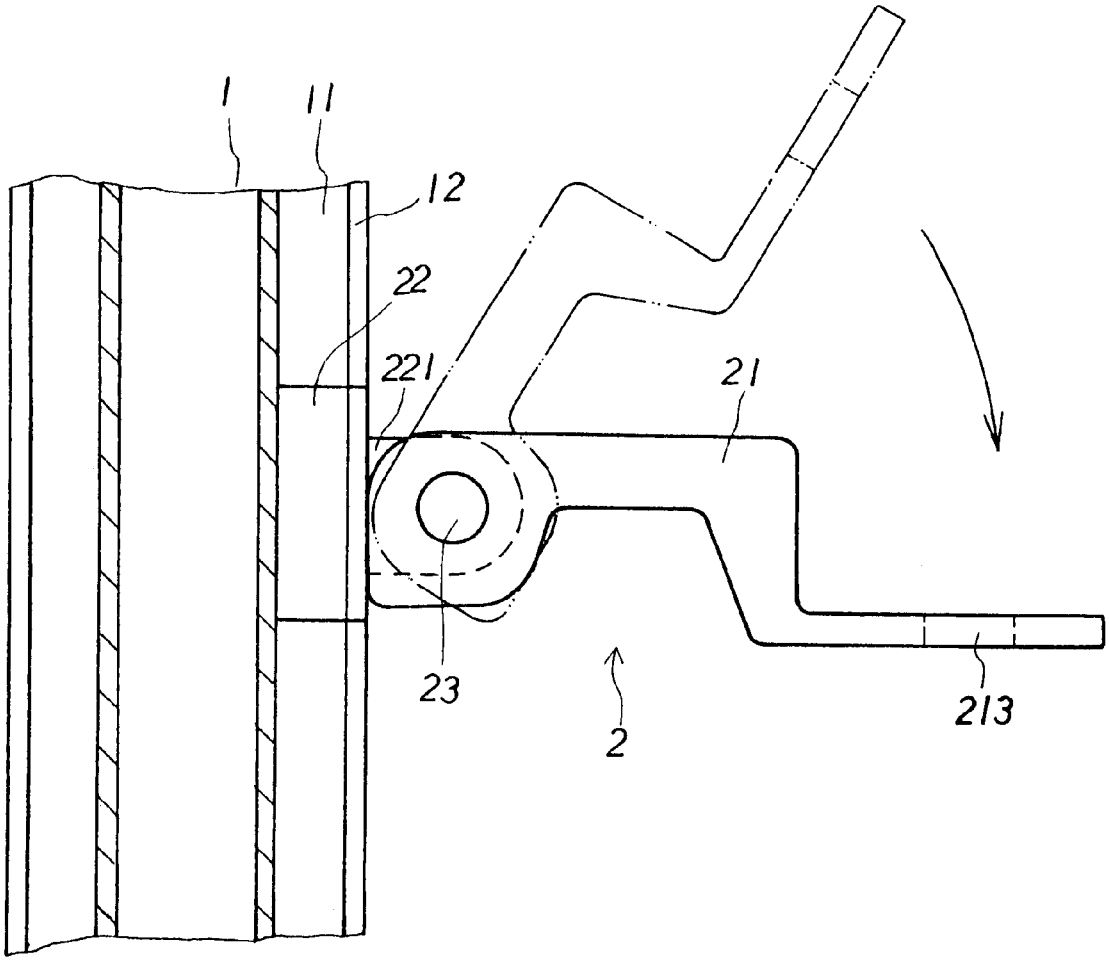
FIG. 4 is a plan cross-sectional assembly view of the combination type support rack structure shown in FIG. 2.
Figure 5:
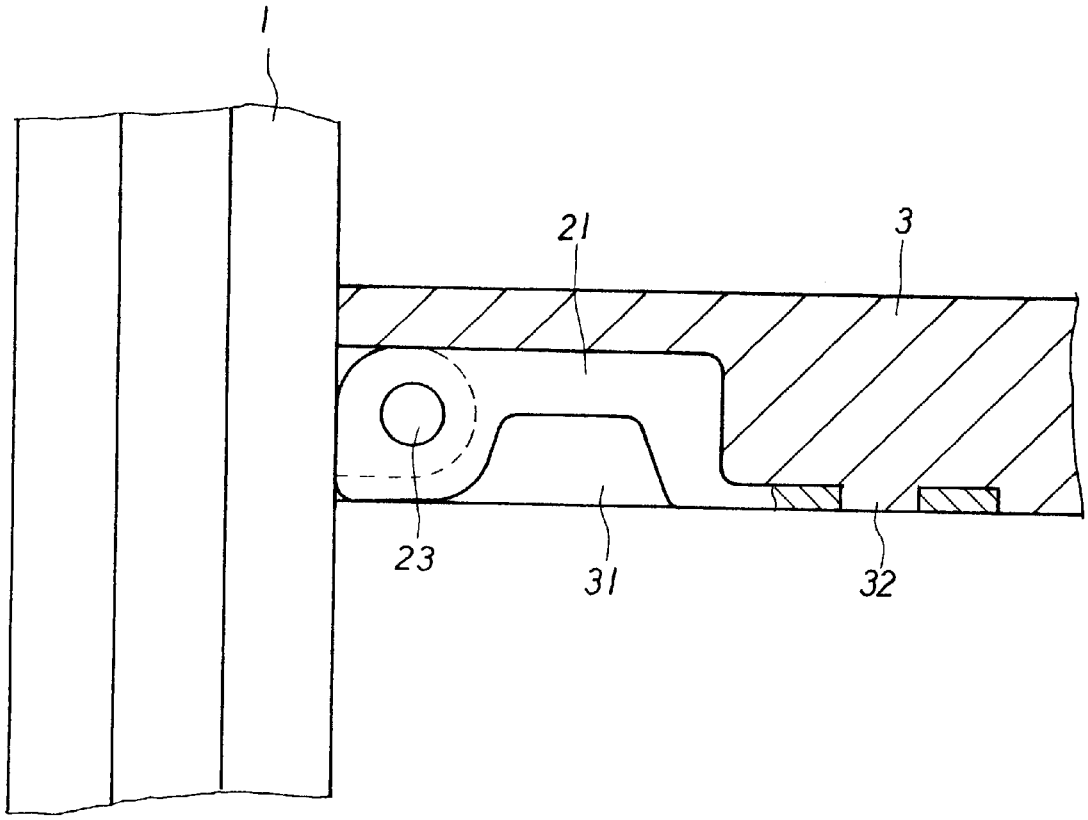
FIG. 5 is a plan cross-sectional assembly view of the combination type support rack structure shown in FIG. 2.

In assembly, referring to FIGS. 1–5, the plate block 21 of each of the support and securing devices 2 is initially pivoted upward as shown in FIG. 4, whereby a gap is formed between the end face of the first end of the plate block 21 and the surface of the support post 11, so that the insertion block 22 of each of the support and securing devices 2 may slide in the insertion groove 11 of the support post 1 freely. When the insertion block 22 of each of the support and securing devices 2 is moved to a predetermined position, the plate block 21 of each of the support and securing devices 2 may be pivoted downward as shown in FIG. 4, whereby the end face of the first end of the plate block 21 is urged on the surface of the support post 11, so that the insertion block 22 of each of the support and securing devices 2 is secured in the insertion groove 11 of the support post 1 and the plate block 21 of each of the support and securing devices 2 is positioned on the surface of the support post 11. Then, the separation board 3 is placed on the plate block 21 of each of the support and securing devices 2, whereby the stepped second end of the plate block 21 of each of the support and securing devices 2 is received in the concave portion 31 of the separation board 3, and the lug 32 of the separation board 3 is secured in the positioning hole 213 of the stepped second end of the plate block 21 of each of the support and securing devices 2.

Thus, multiple separation boards 3 may be successively mounted between the support posts 1 by the support and securing devices 2, thereby forming multiple receiving spaces for receiving articles, so that the support rack structure of the present invention may be assembled easily and quickly, without having to use screws or tools, thereby saving time and manual work. In addition, the support and securing devices 2 may be secured on any position of the support posts, thereby enhancing variation of space of the support rack structure of the present invention.

As shown in FIG. 1, a back board 4 or a side board 5 may be inserted into the insertion grooves 11 between two support posts 1, wherein the back board 4 may be stopped and supported by the separation board 3, and the side board 5 is formed with cutouts 51, so that the side board 5 may be supported by the support and securing devices 2.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination type support rack structure, comprising: multiple upright support posts, at least one separation board mounted between the support posts, and multiple support and securing devices mounted on the support posts for supporting and securing the separation board, wherein:

each face of each of the support posts is formed with at least one insertion groove;

each of the support and securing devices includes an insertion block received in the insertion groove, an ear seat protruded outward from a side of the insertion block, and a plate block pivotally mounted on the ear seat in an eccentric manner;

the plate block of each of the support and securing devices is pivoted upward, whereby a gap is formed between an end face of a first end of the plate block and the surface of the support post, so that the insertion block of each of the support and securing devices can slide in the insertion groove of the support post to a predetermined position;

the plate block of each of the support and securing devices can be pivoted downward, whereby the end face of the first end of the plate block is urged on the surface of the support post, so that the insertion block of each of the support and securing devices is secured in the insertion groove of the support post and the plate block of each of the support and securing devices is positioned on the surface of the support post;

the plate block of each of the support and securing devices has a stepped second end formed with a positioning hole, and the separation board has a bottom face formed with multiple stepped concave portions for receiving the stepped second end of the plate block and each said concave portion being provided with a lug to be secured in the positioning hole of the stepped second end of the plate block.

* * * * *